United States Patent [19]

Ward et al.

[11] Patent Number: 4,849,267

[45] Date of Patent: Jul. 18, 1989

[54] FOAM BACKED CARPET WITH ADHESIVE RELEASE SURFACE AND METHOD OF INSTALLING SAME

[75] Inventors: Robert C. Ward, Dalton, Ga.; Patrick A. Stanton, Signal Mountain, Tenn.

[73] Assignee: Collins & Aikman Corporation, New York, N.Y.

[21] Appl. No.: 188,311

[22] Filed: Apr. 29, 1988

[51] Int. Cl.[4] ..... B32B 5/14; B32B 7/12

[52] U.S. Cl. ..... 428/41; 52/746; 156/71; 156/92; 156/291; 428/43; 428/95; 428/97; 428/159; 428/161; 428/172; 428/173; 428/196; 428/202; 428/203; 428/352; 428/354; 428/355; 428/906

[58] Field of Search ..... 428/40, 41, 43, 95, 428/97, 159, 161, 172, 173, 352, 354, 355, 906, 196, 202, 203; 156/71, 92, 291; 52/746

[56] References Cited

U.S. PATENT DOCUMENTS 3,014,829 12/1961 Curtin ..... 428/95

4,557,774 12/1985 Hoopengardner ..... 428/95

*Primary Examiner*—Marion C. McCamish

*Attorney, Agent, or Firm*—Bell, Seltzer, Park & Gibson

[57] ABSTRACT

A foam backed carpet with an adhesive release surface and a method of installing the carpet is disclosed wherein the carpet has textile fibers secured to a primary backing. A secondary backing formed from a plastisol composition containing polymers or copolymers of vinyl compounds engages the primary backing and an oleophobic pressure sensitive adhesive layer is included on the secondary backing for releasably securing the carpet to an underlying floor. A release cover releasably secured to the layer of pressure sensitive adhesive layer protects and maintains the tackiness of the adhesive layer before laying of the floor covering on an underlying floor.

19 Claims, 3 Drawing Sheets

FOAM BACKED CARPET WITH ADHESIVE RELEASE SURFACE AND METHOD OF INSTALLING SAME

FIELD OF THE INVENTION

This invention relates to pressure sensitive floor coverings and attendant methods of installing the floor covering and more particularly to a carpet preferably in roll form having a secondary backing with a pressure sensitive adhesive layer thereon and an overlying release cover releasably secured to the pressure sensitive adhesive layer.

BACKGROUND OF THE INVENTION

Carpet having a foamed secondary backing engaging a primary backing to which textile fibers are secured commonly is applied to hard floor surfaces, such as concrete, vinyl or vinyl-asbestos, where a secondary backing underlying the primary backing provides the shock absorbent layer needed between the primary backing and the hard surface therebeneath. Usually, the secondary backing is formed from a plastisol composition containing polymers or copolymers of vinyl compounds and is applied onto the primary backing during manufacture of the carpet. Once processed, the carpet usually is convolutely wound into roll form so that during installation, the carpet is unrolled, cut to length and applied to a floor thus avoiding the time consuming process of individually laying a large number of small carpet squares.

However, such installation heretofore has been hindered by the extensive floor surface preparation needed to install this type of carpet. Before unrolling and laying the carpet, an adhesive layer is applied to the underlying floor. When the adhesive has set, which typically can take a number of hours depending on the type of adhesive, the carpet then is applied and secured from shifting relative to the underlying floor by the adhesive layer. However, the drawbacks of this prior art technique are readily apparent. Not only is it time consuming, but it also is inherently untidy and bothersome since workmen often must walk upon the applied adhesive to install the carpet. This increases the risk that adhesive could be tracked onto the upstanding carpet surface.

In addition, it is well known in the trade that plasticizer migration inherent in the vinyl plastisol secondary backing causes the degradation of most adhesives. After a number of years following installation of these carpets having the vinyl plastisol secondary backings, the plasticizer migration has degraded most adhesives so that the tackiness and cohesiveness supplied by the adhesive has been reduced. If the carpet subsequently is peeled off the floor, the degraded adhesive is retained thereon. This is especially critical if the adhesive and carpet originally had been applied to a vinyl-asbestos underlying floor. The adhesive's ability to "lock-in" the asbestos is reduced as the adhesive degrades so that asbestos ultimately migrates out from the floor. Although numerous attempts have been made to find a suitable adhesive which is not adversely affected by plasticizer migration inherent in the secondary backing, tests have shown that most commercially available adhesives degrade when used to secure carpets having secondary backings formed of vinyl plastisol compositions.

Finally, any adhesive applied to an underlying floor prior to the installation of an overlying carpet has a greater affinity for the underlying floor than for the installed carpet. Even if a carpet is removed before plasticizer migration has appreciably degraded the adhesive, upon removal of the carpet, the adhesive residue still remains on the underlying floor.

Some prior art techniques have attempted to solve the affinity problem by applying a pressure sensitive adhesive to the backside of a carpet square so as to retain the adhesive on the carpet square if the carpet is peeled away from the floor. U.S. Pat. No. 3,014,829 is representative of the technique of using carpet squares, commonly referred to as carpet tiles, and discloses a pressure sensitive adhesive applied onto a relatively thick, backing pad or cushion serving as a secondary backing as commonly present on conventional carpet squares or tiles. However, it has been found that these efforts have been limited for several reasons. First, industry custom prefers the quicker and more efficient installation of carpet in the form of roll goods. Second, the degradation encountered by most commercially available adhesives when used on the more common vinyl plastisol secondary backings limits their use.

With the foregoing in mind, it is the primary object of this invention to provide a pressure sensitive carpet and method of installing same wherein the carpet includes a vinyl plastisol secondary backing having a pressure sensitive adhesive layer thereon for releasably securing the carpet to an underlying floor and wherein the pressure sensitive adhesive layer is not adversely affected by the plasticizer migration inherent in the secondary backing.

It is a further object of the invention to provide a pressure sensitive carpet in rolled form and method of installing same wherein the carpet includes a vinyl plastisol secondary backing and a pressure sensitive adhesive layer thereon for releasably securing the carpet to an underlying floor and wherein the pressure sensitive adhesive layer is not adversely affected by plasticizer migration inherent in the secondary backing.

SUMMARY OF THE INVENTION

In accordance with the present invention a floor covering is disclosed comprising a carpet having textile fibers defining a fibrous face and a primary backing to which the textile fibers are secured and a secondary backing formed from a plastisol composition containing polymers or copolymers of vinyl compounds engaging the primary backing.

The secondary backing includes a pressure sensitive adhesive thereon for releasably securing the floor covering to an underlying floor. The adhesive is oleophobic and has high shear strength for preventing slippage between the floor covering and an underlying floor and has low tensile strength to facilitate removal and replacement of the floor covering by permitting peeling of the carpet from the floor. The affinity and cohesiveness of the oleophobic adhesive layer for the secondary backing is greater than that for an underlying floor to permit removal and replacement of the floor covering without any appreciable amount of adhesive being removed from the secondary backing and left on the floor. A release cover releasably secured to the layer of pressure sensitive adhesive protects and maintains the tackiness of the adhesive layer before laying of the floor covering on an underlying floor.

In the preferred embodiment, the textile fibers forming the fibrous face are pile yarns. Printed arrows are present on the secondary backing corresponding to a predetermined direction of the lie of the pile yarns of the carpet. The layer of pressure sensitive adhesive and the release cover are transparent so as to allow the printed arrows to be readily visible to facilitate orientation of various sections of the floor covering in a common direction during installation so that the lie of the pile yarns of all of the sections may readily be oriented in a common direction.

BRIEF DESCRIPTION OF THE DRAWING

Some of the objects and advantages of the present invention having been stated, others will appear as the description proceeds, when considered in conjunction with the accompanying drawings, in which.

DETAILED DESCRIPTION

Figure 1:
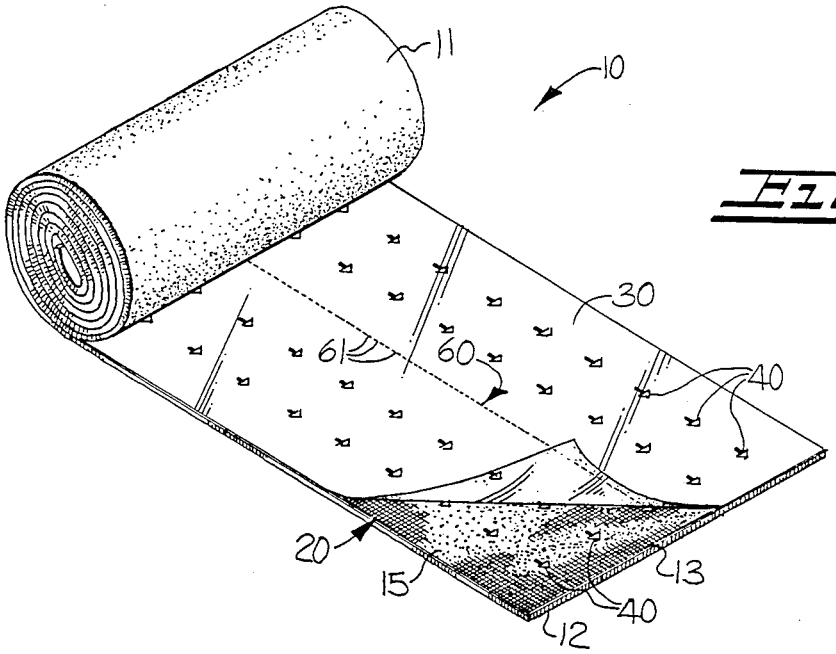
FIG. 1 is a perspective view of a convolutely wound roll of floor covering in accordance with the present invention.
Figure 3:
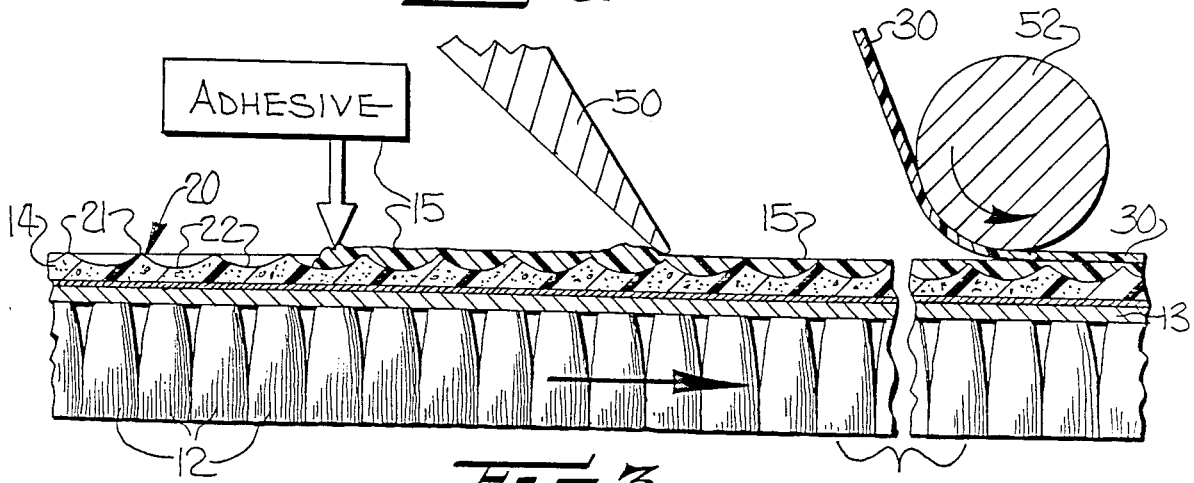
FIG. 3 is an enlarged diagrammatic view of a section of FIG. 2 but showing in greater detail the application of a pressure sensitive adhesive layer and release cover.

Referring now specifically to the drawings and more particularly to FIG. 1, reference numeral 10 designates a preferred embodiment of the floor covering subsequent to its manufacturing wherein the floor covering is convolutely wound into a roll 11 so that the fibrous face of the floor covering faces outwardly of the roll. As best seen in FIG. 3, the floor covering 10 is formed of pile yarns 12, defining a fibrous face, which are secured to a primary backing 13. A foam secondary backing 14 formed of a plastisol composition containing polymers or copolymers of vinyl compounds engages the primary backing 13 and is applied to the primary backing 13 by means conventional to the carpet manufacturing industry.

For releasably securing the floor covering 10 to an underlying floor, an oleophobic pressure sensitive adhesive layer 15 is included on the secondary backing 14. By oleophobic we mean a pressure sensitive adhesive which is not adversely affected by the plasticizer migration inherent in the vinyl plastisol secondary backing and which has high shear strength for preventing slippage between the floor covering 10 and an underlying floor and has low tensile strength to facilitate removal and replacement of the floor covering by permitting peeling of the floor covering from the floor. Based upon data received from various accelerated aging tests which simulate releasable securement of the floor covering 10 over protracted time periods, the floor covering can be peeled away without having retention of the oleophobic adhesive to an underlying floor or having rupture of the secondary backing 14.

Preferably, the oleophobic pressure sensitive adhesive comprises a polymer or copolymer of at least one ethylenically unsaturated monomer. Particularly suitable are pressure sensitive adhesives derived from acrylic monomers. Exemplary acrylic monomers include aklyl esters of acrylic acid with an alkyl group having from 1 to 18 carbon atoms, including methyl, ethyl, n-butyl, sec-butyl, the various isomeric pentyl, hexyl, heptyl, and octyl (especially 2-ethylhexyl), lauryl, cetyl, stearyl and like groups; and alkyl esters of methacrylic acid with an alkyl group having from 4 to about 18 carbon atoms, including n-butyl, n-hexyl, 2-ethylhexyl, n-octyl, lauryl, cetyl, stearyl and like groups. These monomers are selected to provide the high shear strength and low tensile strength needed to one skilled in the art. One particularly suitable pressure sensitive adhesive which from testing is deemed to be commercially acceptable is an 80/20 copolymer of butyl acrylate/2-ethyl hexyl acrylate.

It also has been determined that a wide range of initial tensile or "peel" strength values ranging from 0.1 to 4.0 pounds an inch for the oleophobic pressure sensitive adhesive layer 15 is optimum for the adhesive bond strength. Test criteria based on the 180° angle peel adhesion standard as outlined by PSTC-1 (Pressure Sensitive Tape Council) in the PSTC Standard Test Method Booklet has determined that if the adhesive layer 15 has a tensile or "peel" strength greater than 4.0 pounds per inch, the secondary backing 14 will tear when the floor covering is removed. With values under 0.1 pounds per inch, the floor covering 10 has so little cohesiveness that it will not stick to the floor. High temperature oven aging tests have determined that the adhesive layer 15 can withstand temperatures to at least 250° F. without adverse affect. On a chair test face-rated 2 at 100,000 cycles applied to ½ vinyl tile and ½ sealed particle board, all seams remained in good condition.

Figure 5:
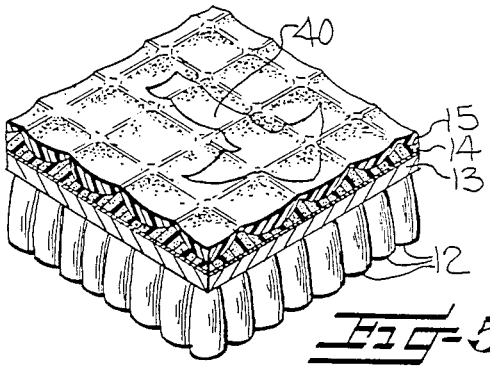
FIG. 5 is a cutaway perspective view similar to FIG. 4, but having the release cover removed from the secondary backing.

As best seen in FIGS. 1, 3 and 5 the secondary backing 14 has an embossed pattern 20 defining respective high and low areas 21, 22 to which the adhesive layer 15 is applied. The embossed pattern 20 can be used to regulate the volume of adhesive applied during processing since the adhesive fills the recessed portions of the embossed pattern 20 which can be manufactured to various depths. However, as will hereinafter be described in detail, the embossed pattern 20 primarily is provided to facilitate installation of the floor covering 20 when it initially is installed. Only the high areas 21 of the embossed pattern 20 contact an underlying floor surface so that the minimal surface area contact between the pressure sensitive layer 15 and an underlying floor permits easy shifting of the floor covering 10 about the floor.

Figure 4:
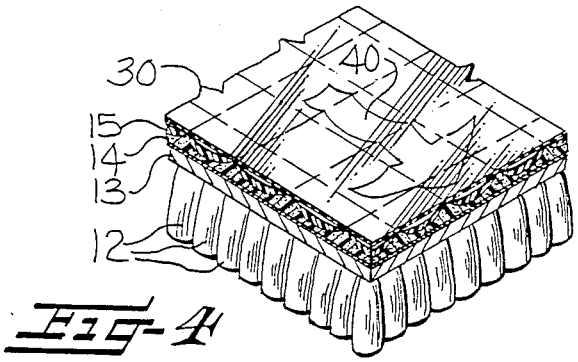
FIG. 4 is a cutaway perspective view of a section of the floor covering showing an arrow printed on the secondary backing and a release cover applied thereto.

To protect and maintain the tackiness of the pressure sensitive adhesive layer 15 before laying of the floor covering 10 on an underlying floor, a release cover 30 is releasably secured to the pressure sensitive adhesive layer. The release cover 30, as well as the adhesive layer 15, are transparent so as to allow arrows 40 printed on the secondary backing 14 to be readily visible through both the adhesive layer and release cover (FIG. 4). The arrows 40 are printed to correspond to a predetermined direction of the lie of the pile yarns 12 of the carpet face so as to facilitate orientation of various sections of the floor covering 10 in a common direction during installation so that the lie of the pile yarns 12 of all of the sections may readily be oriented in a common direction.

Figure 2:
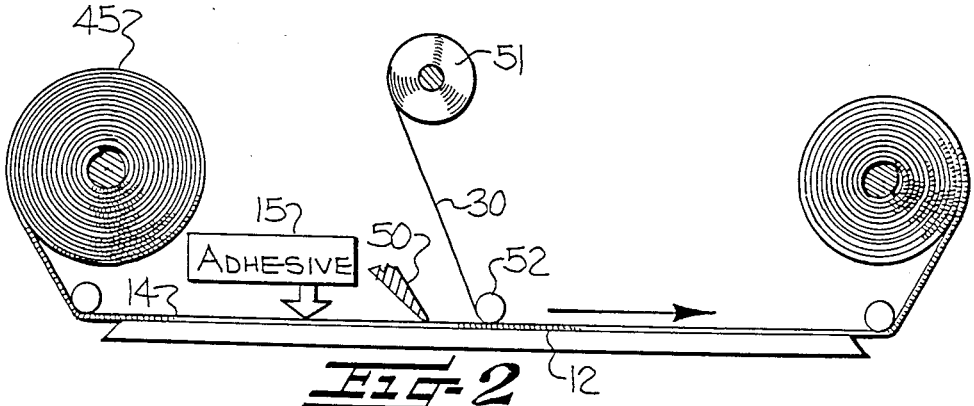
FIG. 2 is a highly diagrammatic view of one stage in the manufacturing of the floor covering when the pressure sensitive adhesive and protective release cover are applied thereto.

Referring now more particularly to FIGS. 2 and 3, the final stage in the manufacturing of the floor covering 10 is shown wherein the adhesive layer 15 and the release cover 30 are applied thereon. The floor covering 10 arrives from initial processing (not shown) where the secondary backing 14 has been applied to the primary backing 13 by means conventional in the carpet manufacturing industry. As is also conventional, the floor covering 10 without adhesive is convolutely wound into roll form 45 with pile yarns facing outwardly therefrom.

During processing, the roll 15 is unwound so that the secondary backing 14 faces upwardly and the oleophobic adhesive 15 is applied onto the secondary backing 14 where it may substantially fill the recesses in the embossed pattern 20 thereon. To regulate the amount of adhesive applied, the floor covering traverses under a doctor blade 50 conventional to the industry which is adjusted to scrape the adhesive and if needed the high areas 21 of the embossed pattern 20 so as to evenly apply the adhesive layer 15 onto the secondary backing 14 The adhesive is then dried by oven and drying apparatus (not shown). In the preferred embodiment, the adhesive 15 is applied in the amount of 0.5 to 1.5 ounces per square yard so as to provide an acceptable level of intended tackiness and cohesiveness needed for releasably securing the floor covering 10 to the underlying floor.

Once the adhesive has dried, the release cover 30 is fed under tension from a continuous feed roll 51 and applied to the secondary backing 14 by a pressure roller 52. Once the release cover 30 is applied, the floor covering 10 is convolutely wound into roll form where pile yarns 12 face outwardly therefrom. To minimize wrinkling of the release cover 30 during convolute winding, and to minimize wrinkling thereafter, the release cover 30 is formed of a linear low density polyethylene having inherent stretchability. A ten percent stretch during application of the release cover 30 onto the secondary backing 14 has been found sufficient to minimize wrinkling thereof.

Figure 6:
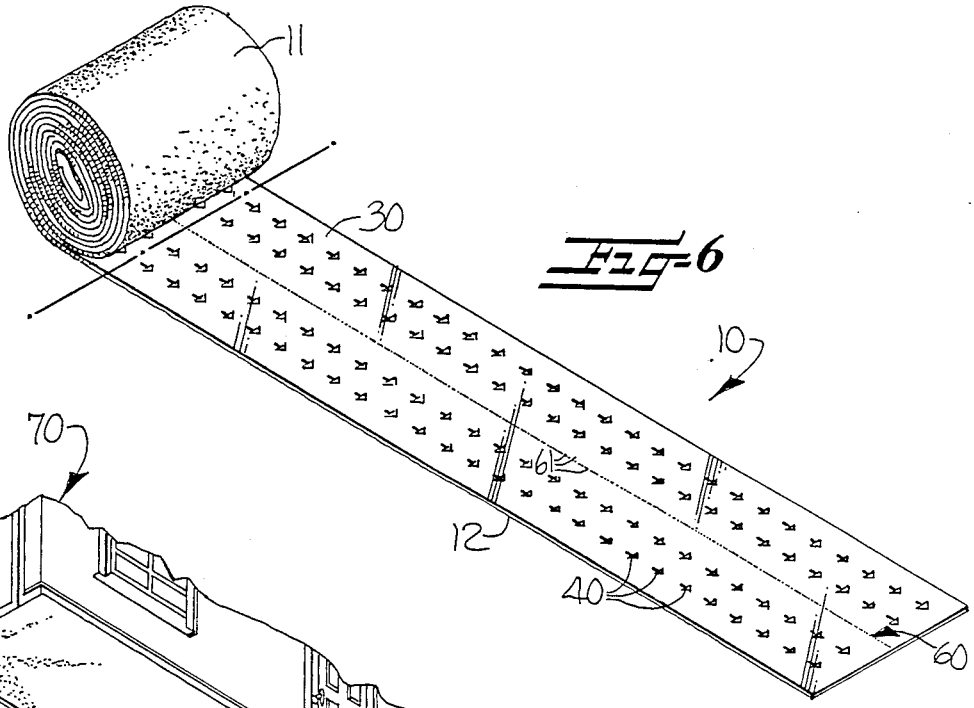
FIG. 6 is a perspective view of a roll of floor covering showing a predetermined length of floor covering unwound prior to cutting.

As shown in FIGS. 1 and 6, the release cover 30 includes thereon at least one longitudinal tear line 60 formed from a plurality of perforations 61. Tear line 60 is formed by conventional means prior to the application of the release cover 30 onto the secondary backing 14 and as will be described later facilitates installation of the floor covering 10. Although the illustrated embodiment shows only a single tear line 60 located in a medial portion thereof, two or more spaced-apart longitudinal tear lines may be incorporated into the release cover 30. However, as later explained, a single medially located tear line 60 is preferred due to its facilitating installation.

Figure 7:
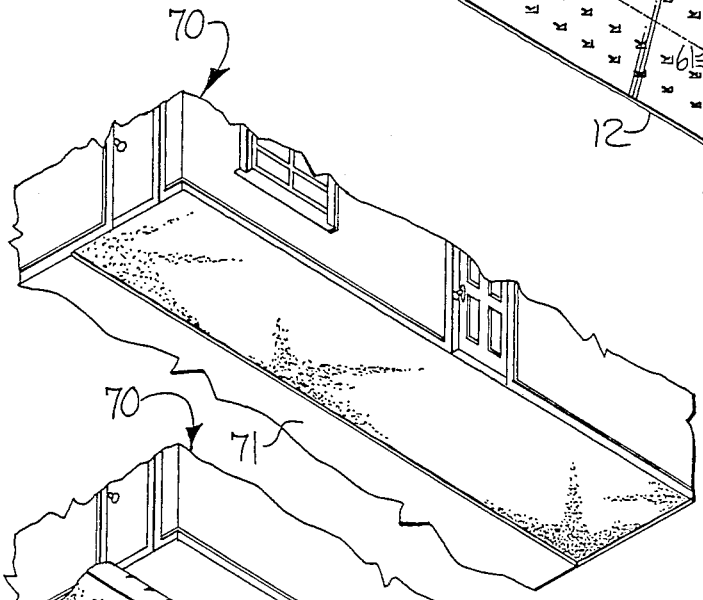
FIG. 7 is a perspective view showing the cut length of FIG. 6 laid upon an underlying floor.

Referring now more particularly to FIGS. 6 through 11 there is shown the preferred method for installing the floor covering 10 in accordance with the present invention. After having measured a room 70 for accurate dimensions, the floor covering 10, which is provided in six foot widths, is unrolled from the convolutely wound roll 11 so that the pile yarns 12 face downwardly so that the floor covering 10 can be cut from the secondary backing 14 toward the pile yarns 12 (FIG. 6). The cut length is then laid with pile yarns 12 facing upwardly on the floor 71 to be carpeted (FIG. 7).

Figure 8:
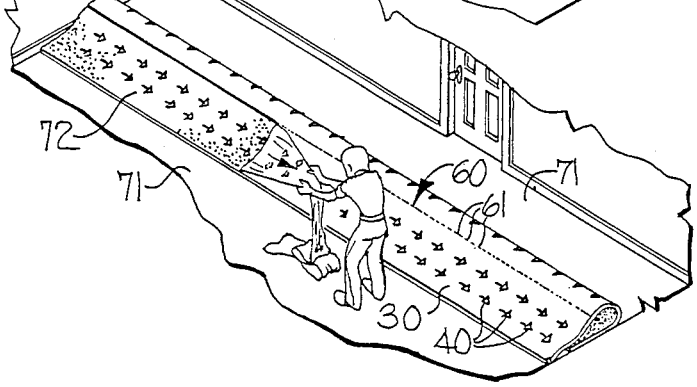
FIG. 8 is a perspective view showing the floor covering of FIG. 7 folded upon itself wherein the pile yarns of the folded portions oppose one another so that the release cover can be ruptured along the tear line to expose the layer of pressure sensitive adhesive.
Figure 9:
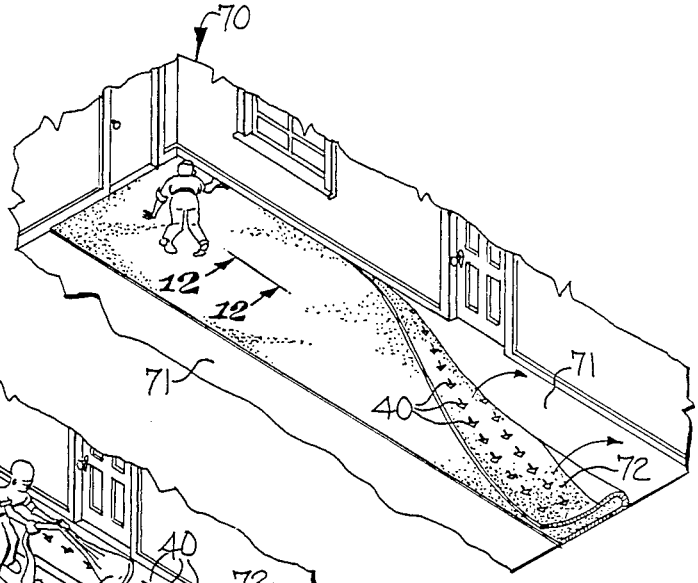
FIG. 9 is a perspective view showing the floor covering of FIG. 8 wherein the floor covering is unfolded to position the exposed pressure sensitive adhesive to the underlying floor.
Figure 10:
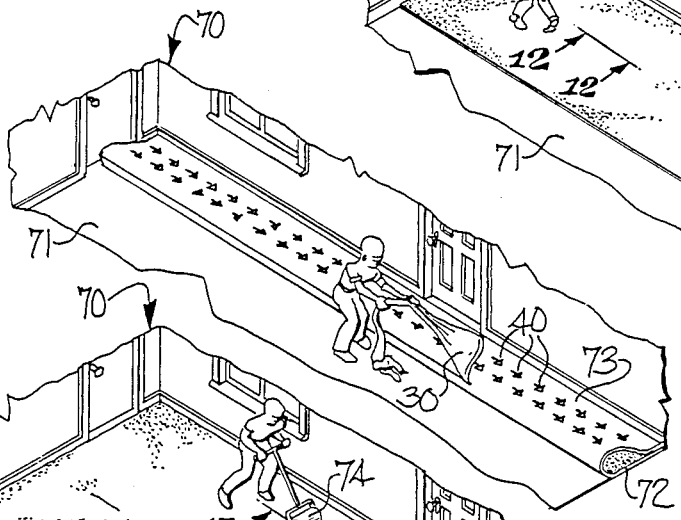
FIG. 10 is a perspective view showing the floor covering of FIG. 9 wherein the remainder of the cut length of carpet is folded to overlie the portion of carpet secured to the floor so that the release cover adhering to the remainder of the cut length can be removed.
Figure 11:
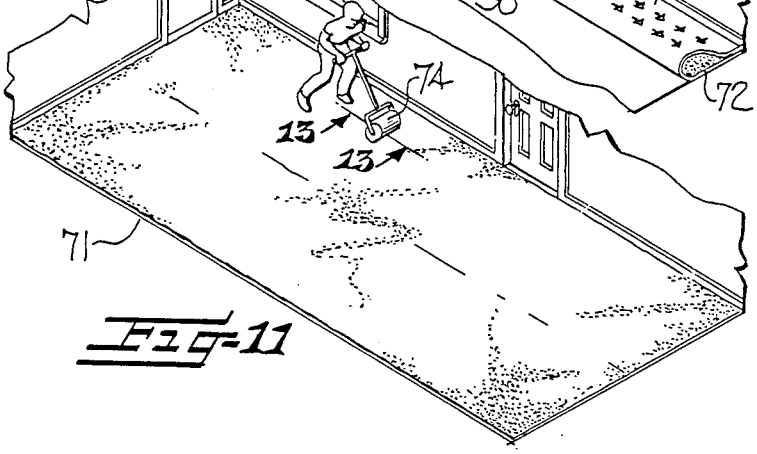
FIG. 11 is a perspective view showing pressure rolling of the installed floor covering and a second floor covering section applied adjacent thereto.

The floor covering 10 is then folded upon itself so that the pile yarns 12 of the folded portions oppose one another. The release cover 30 on the uppermost folded-over length 72 of floor covering is then removed by rupturing the release cover 30 along the tear line 60 to expose the layer of pressure sensitive adhesive 15 (FIG. 8). Next, the folded-over length 72 having the now exposed adhesive layer 15 is unfolded and positioned against the floor 71 to releasably secure the floor covering 10 (FIG. 9). The remainder 73 of the cut length of the floor covering 10 is now folded to overlie the portion 72 secured to the floor 71 and the remainder portion of the release cover 30 is removed (FIG. 10). Finally the pressure sensitive adhesive layer of the remainder portion 73 is positioned and releasably secured to the floor 71 (FIG. 11).

Figure 12:
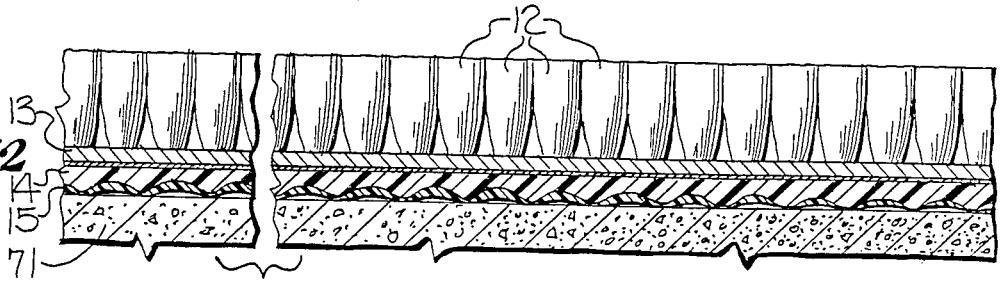
FIG. 12 is an enlarged sectional view of the installed floor covering taken along line 12—12 of FIG. 9 before pressure rolling.
Figure 13:
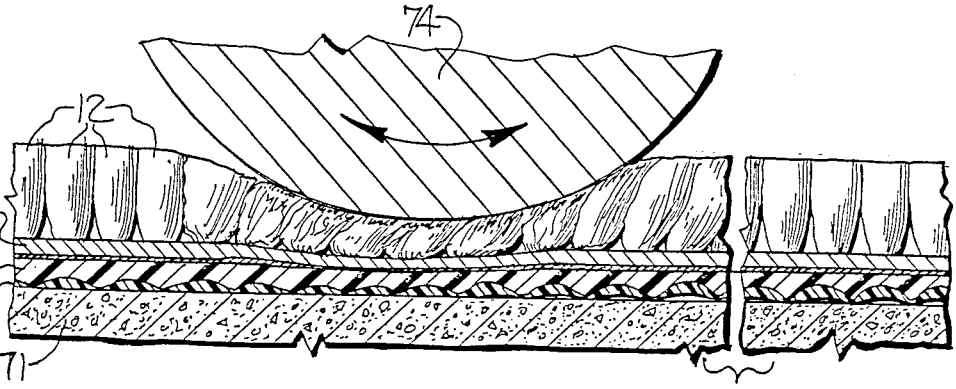
FIG. 13 is an enlarged sectional view of the installed floor covering taken along line 13—13 of FIG. 11 after pressure rolling.

When the floor covering 10 initially is installed, it easily can be peeled upwardly away from the underlying floor 71 for accurate positioning. When first installed, only high areas 21 of the embossed pattern 20 contact the underlying floor 71, causing minimal surface area contact between the pressure sensitive adhesive layer 15 and the floor 71 so that the tensile and shear strength of the floor covering 10 relative to the floor 71 (FIG. 12) is of a relatively low value. However, when the floor covering 10 has been oriented in its desired position, it may be pressure rolled (FIG. 11) by a pressure roller 74. During pressure rolling, low areas of the embossed pattern are pressed downwardly into engagement with the underlying floor 71 so that the entire embossed pattern 20 engages the underlying floor 71. Thus, the surface area contact between the adhesive and the underlying floor is increased resulting in increased tensile and shear strengths (FIG. 13).

If a plurality of cut lengths are to be installed (FIG. 11), the same method is applied. However, care must be exercised to assure that the printed arrows 40 on all the cut lengths point in a predetermined common direction so that the lie of the pile yarns 12 of all the cut lengths is oriented in a common direction.

Should access to various telephone or electrical trunk lines extending through the underlying floor 71 be required, the adhesively secured floor covering 10 can be removed by peeling it upwardly away from the underlying floor 71. A release cover 30 then can be reapplied to the exposed layer of pressure sensitive adhesive 15 on the removed cut length so as to protect the exposed layer of adhesive 15 and to facilitate handling of the removed floor covering 10 until reinstalled.

As an alternative method of applying the floor covering 10, after initial processing, the roll 11 can be cut into preselected square configurations, i.e. one foot dimensioned carpet squares. Then, individual carpet squares can be installed. However, such method has been found to be more time consuming and currently is not the desired method of installing among those skilled in the art.

In the drawings and specification there has been set forth preferred embodiments of this invention, and although specific terms are employed, they are used in a generic and descriptive sense only and not for purposes of limitation, the scope of the invention being defined in the following claims.

That which is claimed is:

1. A floor covering comprising a carpet having textile fibers defining a fibrous face and a primary backing to which the textile fibers are secured, a secondary backing engaging said primary backing, said secondary backing being a plastisol composition containing polymers or copolymers of vinyl compounds, a layer of pressure sensitive adhesive on said secondary backing for releasably securing the floor covering to an underlying floor, said adhesive being an oleophobic adhesive and having high shear strength for preventing slippage between the floor covering and an underlying floor and having low tensile strength to facilitate removal and replacement of the floor covering by permitting peeling of the carpet from the floor and wherein the affinity and cohesiveness of the layer of oleophobic adhesive for the secondary backing is greater than that for an underlying floor to permit removal and replacement of the floor covering without any appreciable amount of adhesive being removed from the secondary backing and left on the floor, and a release cover releasably secured to said layer of pressure sensitive adhesive to protect and maintain the tackiness of the adhesive layer before laying of the floor covering on an underlying floor.

2. The floor covering as claimed in claim 1 wherein said release cover is stretchable to minimize wrinkling thereof during convolute winding in the formation of a roll of floor covering and to minimize wrinkling thereafter.

3. The floor covering as claimed in claim 2 wherein said release cover is formed of a linear low density polyethylene for obtaining the desired stretchability and for minimizing wrinkling.

4. The floor covering as claimed in claim 1 wherein said textile fibers forming said fibrous face are pile yarns, and wherein printed arrows are present on said secondary backing corresponding to a predetermined direction of the lie of the pile yarns of the carpet, and wherein said layer of pressure sensitive adhesive and said release cover are transparent so as to allow said printed arrows to be readily visible to facilitate orientation of various sections of the floor covering in a common direction during installation so that the lie of the pile yarns of all of the sections may readily be oriented in a common direction.

5. The floor covering as claimed in claim 1 wherein said release cover has at least one line of spaced-apart perforations defining a tear line in a medial portion thereof to facilitate installation of the floor covering.

6. The floor covering as claimed in claim 1 wherein said carpet is a convolute wound roll of carpet and said release cover is stretchable to minimize wrinkling during formation of the roll and thereafter.

7. The floor covering as claimed in claim 1 wherein said carpet is in the form of a carpet square.

8. The floor covering as claimed in claim 1 wherein said oleophobic pressure sensitive adhesive comprises a polymer or copolymer of at least one ethylenically unsaturated monomer.

9. The floor covering as claimed in claim 1 wherein said secondary backing has an embossed pattern on the outer face thereof defining high and low areas.

10. A floor covering comprising a carpet having pile yarns forming a fibrous face and a primary backing to which the pile yarns are secured, a secondary backing engaging said primary backing, said secondary backing being a plastisol composition containing polymers or copolymers of vinyl compounds, a transparent layer of pressure sensitive adhesive on said secondary backing for releasably securing the floor covering to an underlying floor, said adhesive being an oleophobic adhesive and having high shear strength for preventing slippage between the floor covering and an underlying floor and having low tensile strength to facilitate removal and replacement of the floor covering by permitting peeling of the carpet from the floor and wherein the affinity and cohesiveness of the oleophobic adhesive for the secondary backing is greater than that for an underlying floor to permit removal and replacement of the floor covering without an appreciable amount of adhesive being removed from the secondary backing and left on the floor, a transparent and flexible release cover formed from linear low density polyethylene releasably secured to said layer of pressure sensitive adhesive to protect and maintain the tackiness of the adhesive layer before laying of the floor covering on an underlying floor, and printed arrows on said secondary backing corresponding to a predetermined direction of the lie of the pile yarns of the carpet, and wherein said printed arrows are readily visible through said transparent layer of pressure sensitive adhesive and said transparent release cover so as to allow said printed arrows to be readily visible to facilitate orientation of various sections of the floor covering in common direction during installation so that the lie of the pile yarns of all of the sections is oriented in a common direction.

11. A floor covering comprising a carpet having textile fibers defining a fibrous face and a primary backing to which the textile fibers are secured, a secondary backing engaging said primary backing, said secondary backing being a plastisol composition containing polymers or copolymers of vinyl compounds, a layer of pressure sensitive adhesive on said secondary backing for releasably securing the floor covering to an underlying floor, said adhesive being an oleophobic adhesive and having high shear strength for preventing slippage between the floor covering and an underlying floor and having low tensile strength to facilitate removal and replacement of the floor covering by permitting peeling of the carpet from the floor and wherein the affinity and cohesiveness of the layer of oleophobic adhesive for the secondary backing is greater than that for an underlying floor to permit removal and replacement of the floor covering without any appreciable amount of adhesive being removed from the secondary backing and left on the floor.

12. A method of installing a convolutely wound carpet having upstanding pile yarns secured to a primary backing with a secondary backing engaging the primary backing and wherein a transparent layer of pressure sensitive adhesive is present on the secondary backing, and wherein a release cover is releasably secured to the layer of pressure sensitive adhesive with the release cover having at least one tear line defined by a plurality of spaced apart perforations, and wherein the secondary backing has printed arrows thereon and readily visible through the release cover with the printed arrows corresponding to a predetermined direction of the lie of the pile yarns of the carpet, said method comprising the steps of (1) unrolling the carpet from the convolutely wound roll with the pile yarns facing downwardly, (2) cutting the downwardly facing unrolled carpet to form at least one cut length of carpet, (3) rupturing the release cover along the tear line and removing a portion of the release cover along one side of the ruptured tear line to expose the underlying layer of pressure sensitive adhesive on the secondary backing of the cut length of carpet, (4) positioning the cut length of carpet with the exposed adhesive layer against the floor to releasably secure the carpet to the floor, (5) removing the release cover from the remainder portion of the cut length of carpet, and (6) positioning the pressure sensitive adhesive layer of the remainder portion against the floor for thus securing the remainder of the cut length of carpet to the floor.

13. A method according to claim 12 wherein a plurality of cut lengths of carpet are formed from the unrolled carpet and said method includes for each of the cut lengths of carpet, repeating steps 3 to 6 while arranging the cut lengths of carpet on the floor with the printed arrows on all the cut lengths pointing in a predetermined common direction so that the lie of the pile yarns of all the cut lengths is oriented in a common direction.

14. A method according to claim 12 including the step of removing a cut length of adhesively secured carpet from the floor to gain access to the floor underlying the carpet such as in the event of a need to service electrical components extending through the floor, and reapplying a release cover to the exposed layer of pressure sensitive adhesive on the removed cut length of carpet so as to protect the layer of pressure sensitive adhesive and to facilitate handling of the removed carpet until reinstalled.

15. A method of installing convolutely wound carpet having upstanding pile yarns secured to a primary backing with a secondary backing engaging the primary backing and wherein a transparent layer of pressure sensitive adhesive is present on the secondary backing, and wherein a release cover is releasably secured to the layer of pressure sensitive adhesive with the release cover having at least one tear line defined by a plurality of spaced apart perforations, and wherein the secondary backing has printed arrows thereon and readily visible through the release cover with the printed arrows corresponding to a predetermined direction of the lie of the pile yarns of the carpet, said method comprising the steps of (1) unrolling the carpet from the convolutely wound roll with the pile yarns facing downwardly, (2) cutting the downwardly facing unrolled carpet to form at least one cut length of carpet, (3) laying the cut length of carpet on the floor with the pile yarns facing upwardly, (4) folding the cut length of carpet upon itself so that the pile yarns of the folded portions oppose one another, (5) removing the release cover on the uppermost folded-over length of carpet by rupturing the release cover along the tear line to expose the layer of pressure sensitive adhesive, (6) then unfolding the folded-over length of carpet with the now exposed adhesive layer thereon while positioning the length of carpet with the exposed adhesive layer against the floor to releasably secure the carpet to the floor, (7) then folding the remainder of the cut length of carpet to overlie the portion of carpet secured to the floor, (8) removing the remainder portion of the release cover, and (9) positioning the pressure sensitive adhesive layer of the remainder portion against the floor for thus securing the remainder of the cut length of carpet to the floor.

16. A method according to claim 15 wherein a plurality of cut lengths of carpet are formed from the unrolled carpet and said method includes for each of the cut lengths of carpet, repeating steps 3 through 9 while arranging the cut lengths of carpet on the floor with the printed arrows on all the cut lengths pointing in a predetermined common direction so that the lie of the pile yarns of all the cut lengths may readily be oriented in a common direction.

17. A method according to claim 15 including the step of removing a cut length of adhesively secured carpet from the floor to gain access to the floor underlying the carpet such as in the event of a need to service electrical components extending through the floor, and reapplying a release cover to the exposed layer of pressure sensitive adhesive on the removed cut length of carpet so as to protect the layer of pressure sensitive adhesive and to facilitate handling of the removed carpet until reinstalled.

18. A method of installing a convolutely wound carpet having upstanding pile yarns secured to a primary backing with a secondary backing engaging the primary backing and wherein a transparent layer of pressure sensitive adhesive is present on the secondary backing, and wherein a release cover is releasably secured to the layer of pressure sensitive adhesive with the release cover having at least one longitudinal tear line defined by a plurality of spaced apart perforations, and wherein the secondary backing has printed arrows thereon and readily visible through the release cover with the printed arrows corresponding to a predetermined direction of the lie of the pile yarns of the carpet, said method comprising the steps of (1) unrolling the carpet from the convolutely wound roll with the pile yarns facing downwardly, (2) cutting the downwardly facing unrolled carpet to form at least one cut length of carpet, (3) laying the cut length of carpet on the floor with the pile yarns facing upwardly, (4) folding the cut length of carpet lengthwise upon itself so that the pile yarns of the folded portions oppose one another, (5) removing the release cover on the uppermost folded-over length of carpet by rupturing the release cover along the longitudinal tear line to expose the layer of pressure sensitive adhesive, (6) then unfolding the folded-over length of carpet with the now exposed adhesive layer thereon while positioning the length of carpet with the exposed adhesive layer against the floor to releasably secure the carpet to the floor, (7) then folding the remainder of the cut length of carpet to overlie the portion of carpet secured to the floor, (8) removing the remainder portion of the release cover, and (9) positioning the pressure sensitive adhesive layer of the remainder portion against the floor for thus securing the remainder of the cut length of carpet to the floor.

19. A method according to claim 18 wherein a plurality of cut lengths of carpet are formed from the unrolled carpet and said method includes for each of the cut lengths of carpet, repeating steps 3 to 9 while arranging the cut lengths of carpet on the floor with the printed arrows on all the cut lengths pointing in a predetermined common direction so that the lie of the pile yarns of all the cut lengths is oriented in a common direction.

* * * * *

US004849267C1

(12) REEXAMINATION CERTIFICATE (4649th)

United States Patent

Ward et al.

(10) Number: US 4,849,267 C1

(45) Certificate Issued: Oct. 1, 2002

(54) FOAM BACKED CARPET WITH ADHESIVE RELEASE SURFACE AND METHOD OF INSTALLING SAME

(75) Inventors: Robert C. Ward, Dalton, GA (US); Patrick A. Stanton, Signal Mountain, TN (US)

(73) Assignee: Collins & Aikman Floorcoverings, Inc., Dalton, GA (US)

Reexamination Request:
No. 90/005,640, Feb. 18, 2000
No. 90/005,913, Jan. 22, 2001

Reexamination Certificate for:

| | |
|---|---|
| Patent No.: | **4,849,267** |
| Issued: | **Jul. 18, 1989** |
| Appl. No.: | **07/188,311** |
| Filed: | **Apr. 29, 1988** |

(51) Int. Cl.[7] ..... B32B 5/14; B32B 7/12

(52) U.S. Cl. ..... 428/41.3; 52/746; 156/71; 156/92; 156/291; 428/43; 428/95; 428/97; 428/159; 428/161; 428/172; 428/173; 428/196; 428/202; 428/203; 428/352; 428/354; 428/355; 428/906

(58) Field of Search ..... 428/40, 41, 41.3, 428/43, 95, 159, 161, 172, 173, 196, 202, 203, 352, 354, 355, 906; 52/746; 156/71, 92, 291

(56) References Cited

U.S. PATENT DOCUMENTS

| | | | | |
|---|---|---|---|---|
| RE24,906 E | * | 12/1960 | Ulrich | 206/59 |
| 3,014,829 A | | 12/1961 | Curtin | 154/49 |
| 3,704,197 A | | 11/1972 | Bahlo | 161/67 |
| 3,922,464 A | | 11/1975 | Silver et al. | 428/355 |
| 4,284,681 A | * | 8/1981 | Tidmarsh et al. | 428/246 |
| 4,617,210 A | | 10/1986 | Zybko | 428/35 |

OTHER PUBLICATIONS

Henry® 630 Article, *Flooring,* p. 118 (Jun. 1983).
Henry® Flooring Adhesives Specification Guide, 6 pages (Dec. 1987).

* cited by examiner

*Primary Examiner*—Terrel Morris

(57) ABSTRACT

A foam backed carpet with an adhesive release surface and a method of installing the carpet is disclosed wherein the carpet has textile fibers secured to a primary backing. A secondary backing formed from a plastisol composition containing polymers or copolymers of vinyl compounds engages the primary backing and an oleophobic pressure sensitive adhesive layer is included on the secondary backing for releasably securing the carpet to an underlying floor. A release cover releasably secured to the layer of pressure sensitive adhesive layer protects and maintains the tackiness of the adhesive layer before laying of the floor covering on an underlying floor.

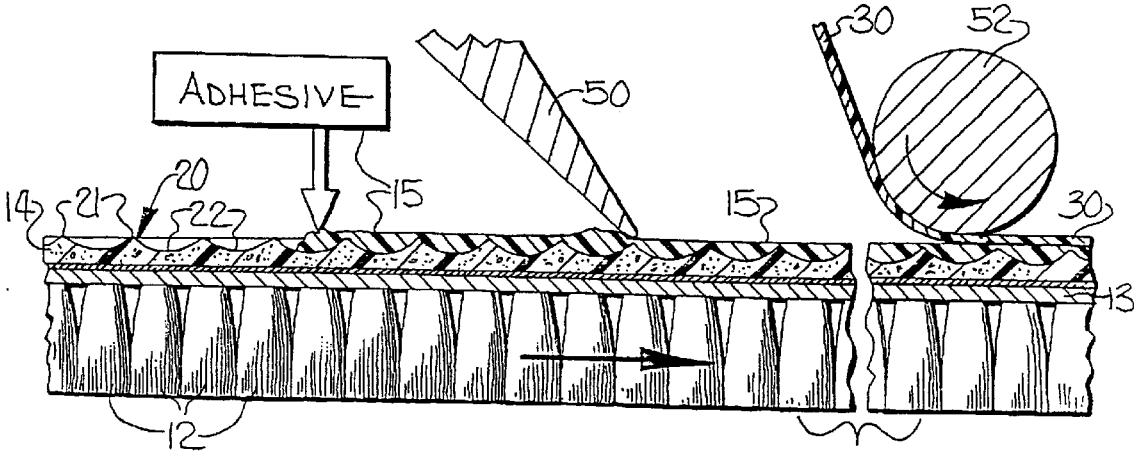

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–19 is confirmed.

* * * * *